US009694940B2

(12) United States Patent
Satkiewicz

(10) Patent No.: US 9,694,940 B2
(45) Date of Patent: Jul. 4, 2017

(54) PLASTIC STORAGE BAG WITH SPOUT

(71) Applicant: Jeremy J. Satkiewicz, New York, NY (US)

(72) Inventor: Jeremy J. Satkiewicz, New York, NY (US)

( * ) Notice: Subject to any disclaimer, the term of this patent is extended or adjusted under 35 U.S.C. 154(b) by 0 days.

(21) Appl. No.: 14/872,625

(22) Filed: Oct. 1, 2015

(65) Prior Publication Data

US 2016/0096657 A1 Apr. 7, 2016

Related U.S. Application Data

(60) Provisional application No. 62/059,447, filed on Oct. 3, 2014.

(51) Int. Cl.

| | |
|---|---|
| ***B65D 33/16*** | (2006.01) |
| ***B65D 25/42*** | (2006.01) |
| ***B65D 33/25*** | (2006.01) |
| ***B65D 75/58*** | (2006.01) |

(52) U.S. Cl.

CPC ..... *B65D 25/42* (2013.01); *B65D 33/2591* (2013.01); *B65D 75/5872* (2013.01)

(58) Field of Classification Search

CPC . B65D 75/5872; B65D 25/42; B65D 33/2591

USPC ..... 383/63, 64, 906, 36

See application file for complete search history.

(56) References Cited

U.S. PATENT DOCUMENTS 2,575,191 A * 11/1951 Seipp ..... B65D 31/04 383/110
2,668,643 A * 2/1954 Irving ..... B65D 5/74 222/541.6
2,772,823 A * 12/1956 Plamann ..... B65D 75/5805 222/527
3,746,215 A * 7/1973 Ausnit ..... B65D 33/00 222/92
4,235,653 A * 11/1980 Ausnit ..... B31B 19/90 156/177
4,657,792 A * 4/1987 Ausnit ..... B31B 41/00 156/250

(Continued)

FOREIGN PATENT DOCUMENTS

EP 000338622 A1 * 10/1989
JP 03162247 A * 7/1991

(Continued)

OTHER PUBLICATIONS

Machine translation of description of JP 2008037499 A.*

(Continued)

*Primary Examiner* — Jes F Pascua
(74) *Attorney, Agent, or Firm* — Ostrolenk Faber LLP

(57) ABSTRACT

A plastic food storage bag having a spout at a top corner of the bag for facilitating pouring out the contents of the bag. The bag can be sealed with the spout in a closed position, just inside the press-seal or zipper-seal of the bag. The spout is rotatable from the closed position into an open position in which it extends out of the bag, for guiding the contents of the bag while being poured out the bag. The spout may be formed of a wedge-shaped plastic piece folded symmetrically along a central fold line, with front and back outside surfaces respectively secured to front and back major surfaces of the bag.

9 Claims, 8 Drawing Sheets

(56) References Cited

U.S. PATENT DOCUMENTS

| | | | | |
|---|---|---|---|---|
| 6,527,444 | B1 * | 3/2003 | Buchman | B65D 33/2591 383/204 |
| 6,783,276 | B2 * | 8/2004 | Machacek | B65D 75/5866 383/36 |
| 7,004,630 | B2 * | 2/2006 | Piechocki | B65D 33/2525 383/36 |
| 8,690,428 | B2 | 4/2014 | Kruse et al. | 383/5 |
| 2011/0052101 | A1 | 3/2011 | Paulse | 383/23 |

FOREIGN PATENT DOCUMENTS

| | | | | |
|---|---|---|---|---|
| JP | 2000-238800 | A | | 9/2000 |
| JP | 2008037499 | A | * | 2/2008 |

OTHER PUBLICATIONS

Translation of Japanese Document No. 2008-37499.*
PCT Notification of Transmittal of the International Search Report and the Written Opinion of the International Searching Authority, or the Declaration (Form PCT/ISA/220) issued Feb. 25, 2016.

* cited by examiner

PLASTIC STORAGE BAG WITH SPOUT

CROSS-REFERENCE TO RELATED APPLICATION

This application is based on and claims priority to Provisional Application No. 62/059,447, filed Oct. 3, 2014, herein incorporated by reference.

BACKGROUND

The invention relates to an improvement in a plastic storage bag, and more specifically to a spout that facilitates pouring out the contents of the bag.

SUMMARY

The disclosed spout improves upon prior bags by permitting the user to store contents and then pour them from the bag in a clean and efficient manner without spilling the contents, and without having the residue clog the closure tracks of the bag, preventing the seal from closing again tightly, which is the key element of this type of closure of this type of bag. That is, an airtight and watertight seal is key to the functionality of the bag in order to preserve the contents and prevent contamination. This improvement is especially useful with liquid contents such as sauces that are stored in the bags, allowing for less waste and cleanup after pouring than with prior bags.

In a bag with a zipper-type or press-seal-type closure (hereafter "the seal"), the spout is pushed into a position inside the bag below the seal after use, permitting a tight re-closure of the bag without residue in the track, ensuring a watertight and airtight seal.

The improvement is applicable to both zipper-type and press-seal-type bags, which are available from various manufacturers. An example of a range of prior food storage bags is the well-known Ziploc® brand of food storage bags from S.C. Johnson & Son, Inc.

More broadly, the disclosed spout feature is applicable, without limitation, to any type of bag or container without regard to shape or material.

Other features and advantages of the invention will be seen in the following description of embodiments thereof.

DETAILED DESCRIPTION

Figure 1:
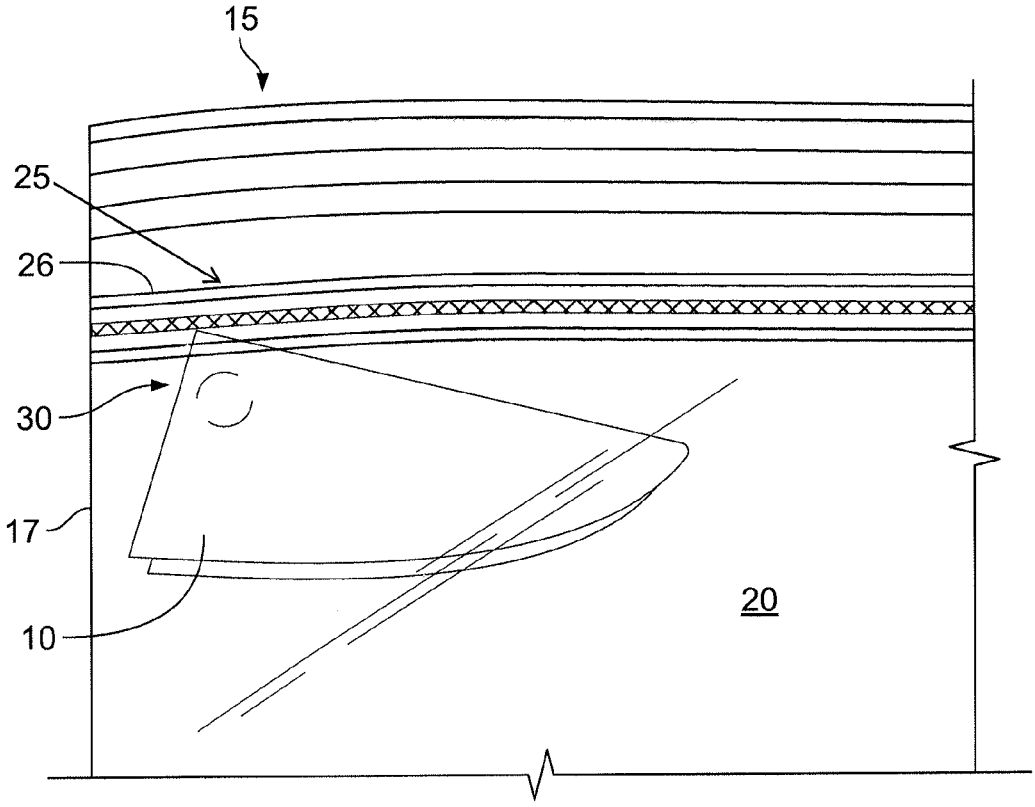
FIG. 1 shows a press-seal-type bag with spout according to a first embodiment of the invention, with the spout in a first (closed) position.
Figure 2:
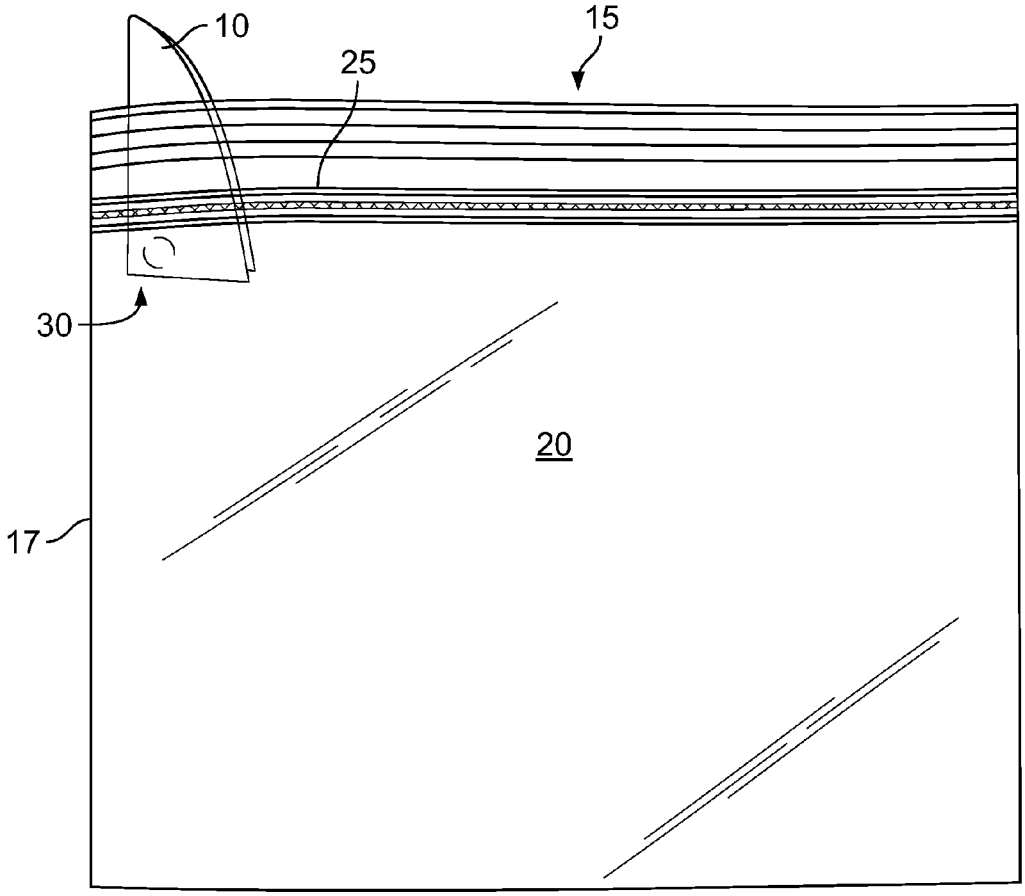
FIG. 2 shows that embodiment of FIG. 1, with the spout in a second (open) position.

According to a first embodiment, shown in FIGS. 1-2, a moving spout 10 is secured near the open side 15 of a bag 20. In this example, the bag is a press-seal type storage bag. The spout has a first position (FIG. 1) in which it is disposed inside the bag, which can be closed over the spout by a press-seal arrangement 25, as shown, to secure the contents of the bag. The press-seal arrangement 25 has respective ridges 26 on the front and back surfaces of the bag that are configured to be linked together by finger pressure by the user.

When the bag has been opened, as shown in FIG. 2, the spout 10 can move about a movement point 30, into a second position in which it is disposed transverse to and extending through the bag opening 15 to guide the outflow of the contents from the bag.

The movement point 30 in FIGS. 1-2 schematically indicates a center for a rotating movement, and is not intended to indicate any specific device or structure that provides for the movement. In one embodiment, the movement point 30 may be a silicone-based flexible adhesive adhered between the spout 10 and one or both of the front and back major sides of the bag 20. The movement point could be provided in other embodiments by other suitable adhesive and/or mechanical arrangements, still within the scope of the invention.

Figure 3A:
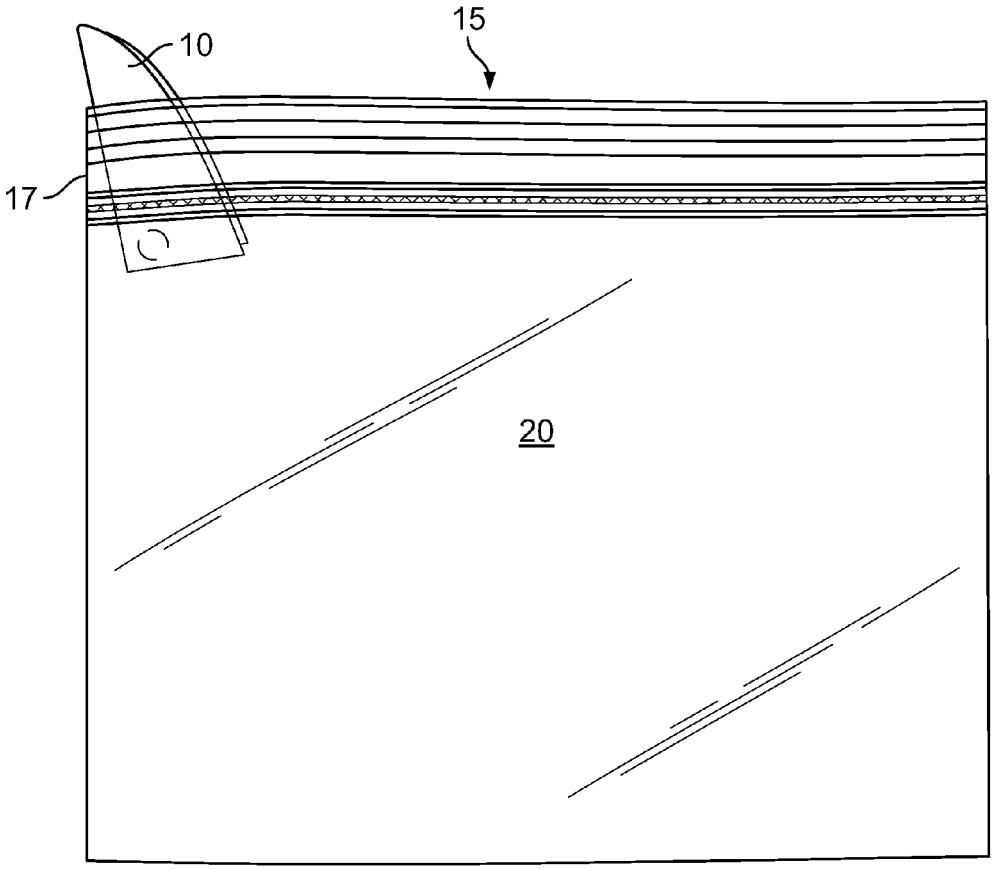
FIG. 3A shows a bag with spout according to a second embodiment of the invention, with the spout resting in a position against a sealed seam of the bag.

In a second embodiment, shown in FIG. 3A, in the second position, the spout may rest against the sealed seam 17 at the end of the bag opening, to be securely braced there in its pouring position.

Figure 3B:
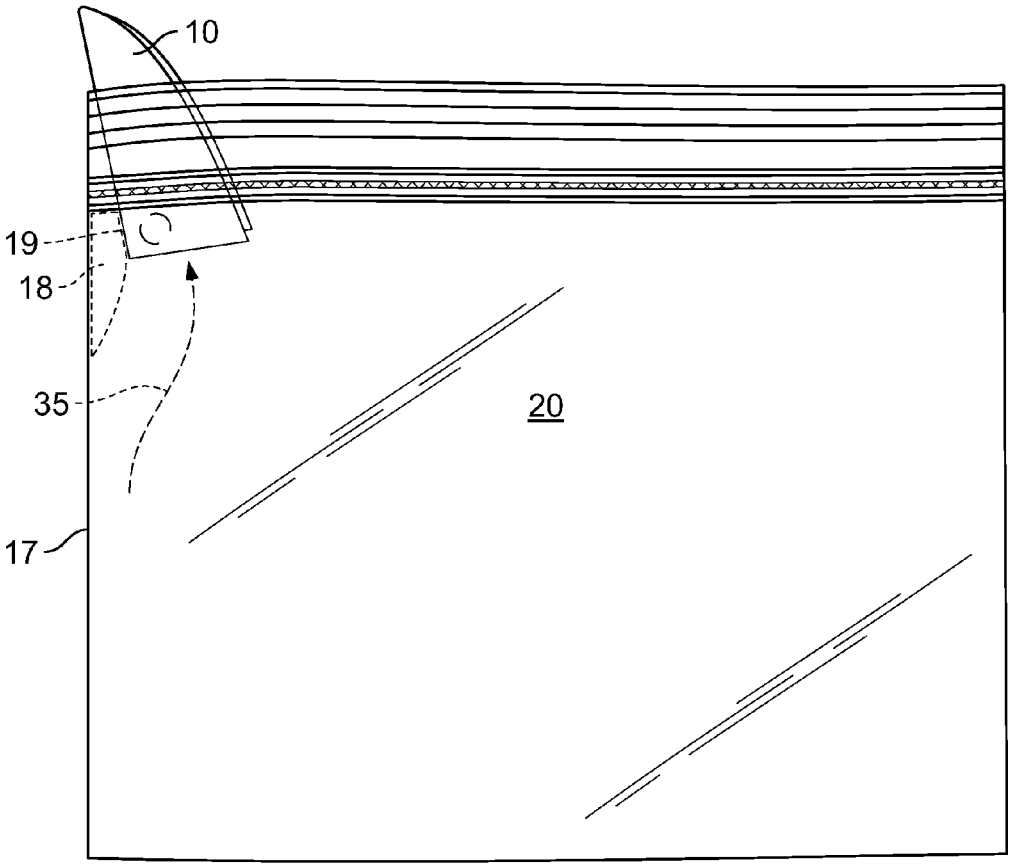
FIG. 3B shown a bag with spout according to a modification of the second embodiment, including a blocked area provided in the bag between the spout and the adjacent seam of the bag.

In a modification of the third embodiment, as shown schematically by broken lines in FIG. 3B, a blocked area 18 may be provided at a corner of the bag, where the front and back major surfaces of the bag are sealed together. The blocked area 18 provides an edge 19 against which the spout 10 can rest in the second position.

As shown by arrow 35 in FIG. 3B, this arrangement facilitates the smooth outflow of the contents of the bag to, and through, the spout 10. The blocked area 18 guides the contents into the spout 10 while preventing the contents from collecting or clogging in an area between the spout 10 and the seam 17.

In alternative embodiments, the bag material may be eliminated at the location shown for the blocked area 18, that is, a cutout can be formed corresponding to the blocked area 18, forming a cut-out shape in the seam 17 and/or the end of the seal above the blocked area 18, with the same advantages as described in connection with FIG. 3B.

Figure 4:
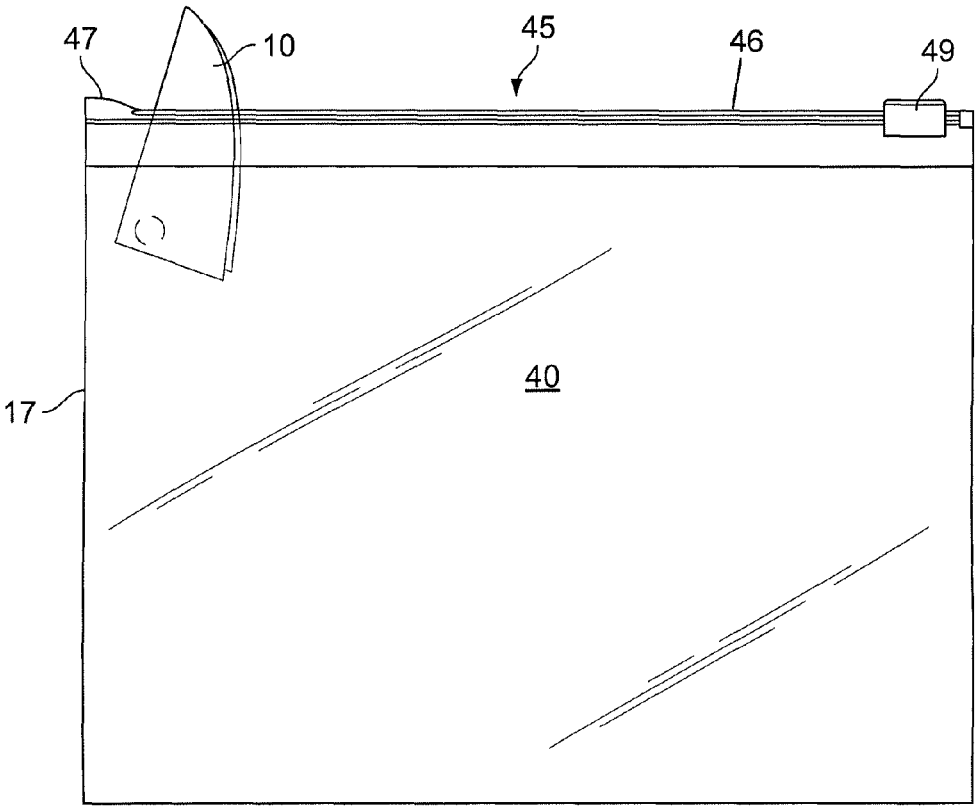
FIG. 4 shows a third embodiment of the invention, comprising a zipper-type bag with a spout.

In a third embodiment, shown in FIG. 4, a plastic food storage bag 40 has a zipper- or slider-type closure 45 with respective ridges 46 on the front and back surfaces of the bag that are configured to be linked and unlinked by a runner 49 in the manner of a zipper. This closure has a blocked end portion 47 where the front and back of the closure are sealed together to provide a strong engagement point for the runner 49.

As shown in FIG. 4, in its open second position, the spout 10 is supported against the blocked end portion 47.

As in the embodiment of FIG. 3B, a blocked area corresponding to the blocked area 18 can be provided in the embodiment of FIG. 4, where the front and back major surfaces of the bag 40 are either sealed together, or eliminated, in the area below the end portion 47 and between the spout 10 and the edge 17.

Figure 5:
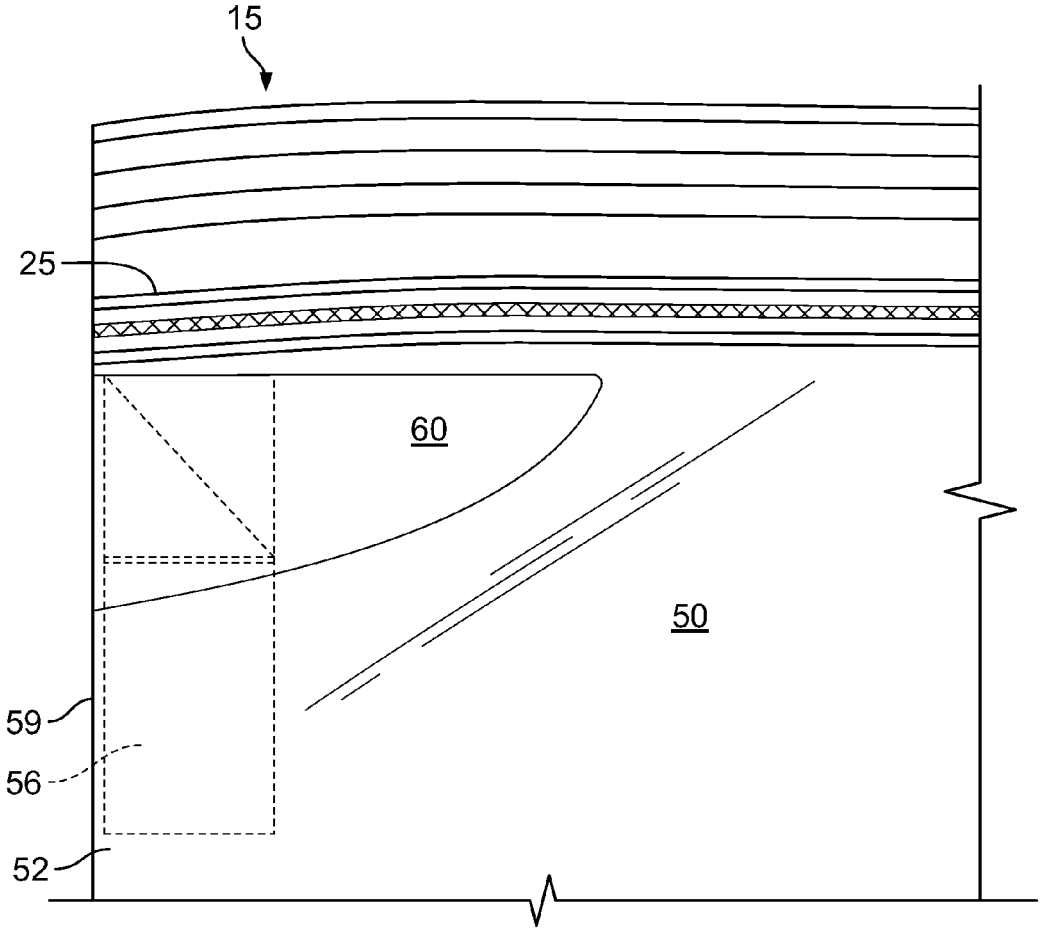
FIG. 5 is a side view of a fourth embodiment of the invention showing the spout in its closed position.
Figure 6:
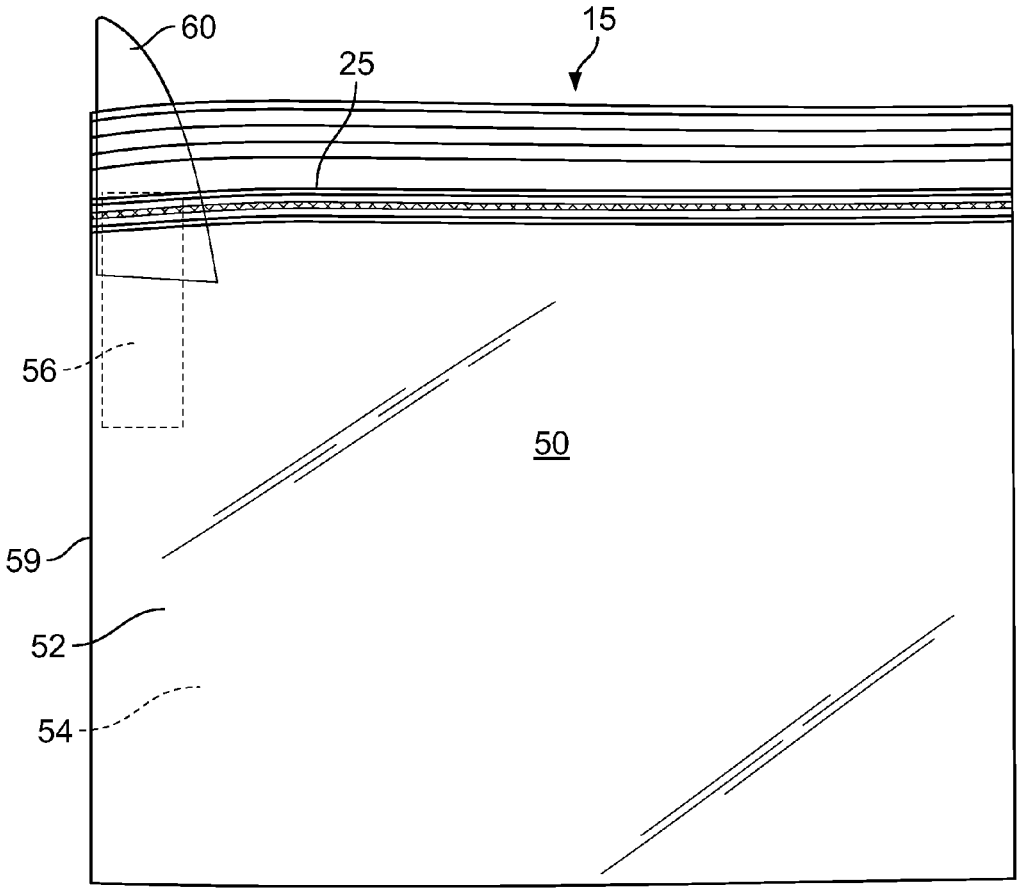
FIG. 6 is a side view thereof showing the spout in its open position.
Figure 7:
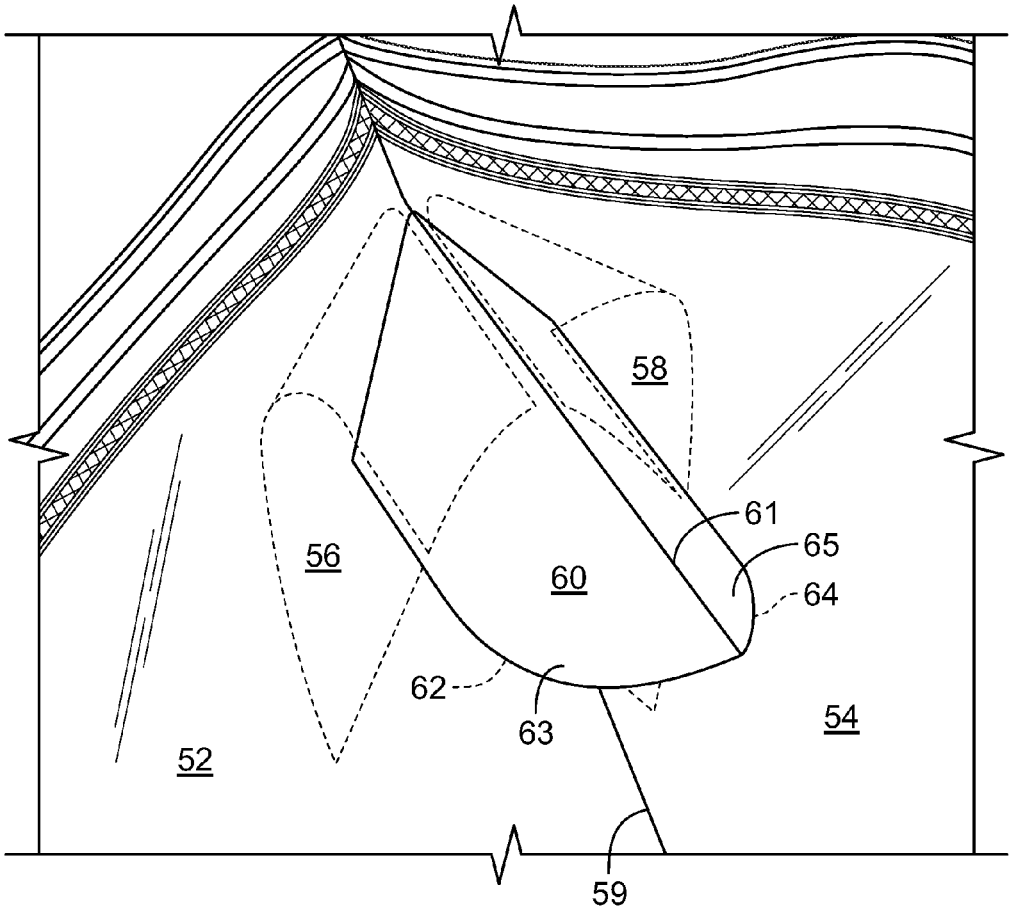
FIG. 7 is a perspective view corresponding to FIG. 5.

FIGS. 5-7 show a fourth embodiment of the invention, in which a bag 50 has front and back major surfaces 52, 54. A spout 60 is adhered to the front and back major surfaces 52, 54 by corresponding films 56, 58.

The films 56, 58 may be formed of the same material as the bag 50 and heat-sealed or otherwise affixed adjacent the edge 59 in the bag manufacturing process. The films 56, 58 may also be applied in a separate process and may be of a different material, such as an adhesive tape adhered to the bag major surfaces 52, 54. In this embodiment, the films extend from the bag surfaces onto front and back inside surfaces 62, 64 of the spout 60. The films could in addition or alternatively be extended from the bag surfaces onto the front and back outside surfaces of the spout 60, if useful or desired.

As seen in a side view in FIG. 5 and a perspective view in FIG. 7, the spout 60 has a dosed position in which it rests inside the bag 50. The spout is preferably secured in the bag at or just below the seal 25, so that the bag can be sealed with the spout just inside the seal 25. As best seen in FIG. 7, the portions of the films 56, 58 inside the spout have bent away from the bag surfaces and support the spout 60 in this position.

In its open position shown in FIG. 6, the spout 60 has pivoted to this position resting against the edge 59, with the films 56, 58 now in their unbent position.

The spout 10, 60 may be formed of a wedge-shaped plastic piece folded symmetrically along a central fold line (see 61 in FIG. 7) with a front outside face 63 and a back outside face 65. However, the shape is not critical as long as the spout is capable of guiding the bag contents as they are being poured out of the bag interior.

The spout may be formed of the same material as the bag 50 and/or the seal 25, or may be made of a different material. The material may be selected to provide a particular degree of stiffness, if desired.

Ribs or other stiffening structures may be added to the spout if desired for a particular application.

Although embodiments of a plastic storage bag with spout have been described, the invention is not limited to such embodiments, but rather extends to modifications and variations thereof that might occur to those having ordinary skill in the pertinent art.

What is claimed is:

1. A storage bag with a spout, comprising:

a storage bag having a top edge, a bottom edge, two side edges, and front and back major surfaces defined between said edges;

said storage bag further having a seal near said top edge, the seal extending between said two side edges, and an interior of the bag being defined between said seal, said side edges, said bottom edge and said front and back major surfaces;

said seal being operable for being opened to give access to contents in the interior of the bag, and for being closed to securely enclose said contents in said interior;

further comprising a spout secured to said bag at a corner defined by said seal and one of said side edges, said spout being solely rotatable about a rotation axis, between a first position and a second position, the rotation axis being located below the top edge and the seal, in the interior of the bag, and generally transverse to the front and back major surfaces of the bag, wherein the rotation axis connects the spout to one or both of the front and back major surfaces of the bag;

in said first position, the spout being disposed in the interior of the bag for being enclosed there by the seal along with the contents; and in said second position, the spout extending from the interior of the bag and outwardly past said top edge, and configured for guiding the contents as they are poured out of the interior of the bag.

2. The storage bag with spout of claim 1, wherein said seal comprises respective ridges on said front and back major surfaces of the bag, said ridges being configured for being linked together by a runner, thereby forming a zipper.

3. The storage bag with spout of claim 1, wherein said seal comprises respective ridges on said front and back major surfaces of the bag, said ridges being configured for being linked together by finger pressure by a user.

4. The storage bag with spout of claim 1, wherein the spout comprises a plastic piece having an inside surface arranged to face the bag interior, and an outside surface arranged to face at least one of said front and back major surfaces of the bag.

5. The storage bag with spout of claim 4, wherein said plastic piece is wedge-shaped and is folded along a central fold line.

6. The storage bag with spout of claim 5, wherein the outside surface of the plastic piece is adhered to at least one of said front and back major surfaces of the bag.

7. The storage bag with spout of claim 6, wherein said outside surface is adhered to the bag by an adhesive.

8. The storage bag with spout of claim 5, wherein said outside surface is adhered to the bag by an adhesive.

9. The storage bag with spout of claim 5, wherein said plastic piece has front and back outer surfaces defined on opposite sides of said central fold line, said front and back outer surfaces being adhered respectively to said front and back major surfaces of the bag.

* * * * *